US006079349A

United States Patent [19]

Simpson

[11] Patent Number: 6,079,349

[45] Date of Patent: Jun. 27, 2000

[54] CANOE AND BOAT SEAT INCLINER APPARATUS

[76] Inventor: Barry K. Simpson, 108 Dimetro Rd., Warren, Vt. 05674

[21] Appl. No.: 09/283,846

[22] Filed: Apr. 1, 1999

[51] Int. Cl.[7] ..... B63B 17/00

[52] U.S. Cl. ..... 114/363

[58] Field of Search ..... 114/363, 347; 297/19, 22, 25, 54; 440/101, 104

[56] References Cited

U.S. PATENT DOCUMENTS

| | | | |
|---|---|---|---|
| 4,843,999 | 7/1989 | Kubus et al. | 114/363 |
| 5,622,403 | 4/1997 | Gonda | 297/19 |

*Primary Examiner*—S. Joseph Morano
*Assistant Examiner*—Patrick Craig Muldoon
*Attorney, Agent, or Firm*—Thomas N. Neiman

[57] ABSTRACT

The canoe and boat seat incliner apparatus is designed to provide a paddler with an apparatus that will provide the ability to shift from a sitting position in a canoe or boat to a kneeling position in the canoe without shifting balance in the water craft and while maintaining a firm, solid and comfortable position on the seat in either position. The apparatus is comprised of a pivoting incliner unit that is attached to the hull section of the canoe or gunwale of a boat. The attachment unit provides a stable solid connection to the hull of the canoe or the boat. The incliner unit is also connected to the seat in the canoe or boat in such a manner as to allow the seat to pivot as the incliner unit does, which allows the paddler to move from the seated position to the kneeling position without losing his or her balance while making the transition. The incliner unit is able to pivot through the use of a pivot assembly comprised of a nut and bolt that is inserted through apertures in the incliner unit and into apertures in the canoe seat. The combination of the shape of the incliner unit and the pivot assembly provides the unique transition capability for the paddler.

8 Claims, 3 Drawing Sheets

CANOE AND BOAT SEAT INCLINER APPARATUS

BACKGROUND OF THE INVENTION

This invention pertains to canoe and boat seats and, in particular, to a canoe and boat seat incliner apparatus that is to be used by individuals canoes or boats and shifting from the sitting to the kneeling position while remaining firmly and comfortably supported by the seat.

Canoe seats typically are suspended from two long bolts through each gunwale to a point at the end of the fore and aft rail of the seat frame. Most recreational canoes have seats fixed in the flat position, while many high performance canoes have a seat inclined to support the paddler in a kneeling position. But both type paddlers occasionally need to use the other position while paddling. There have been a number of attempts to develop a comfortable and easy way to go from the kneeling to the sitting position in a canoe or boat with varying degrees of success. The United States Patent issued to F. W. Zeidler et al, U.S. Pat. No. 1,387,957 on Aug. 16, 1921 for a "Canoe", shows a unit having a mechanism that provides a flexible base that will keep the user in a steady position when the canoe is rocked back and forth. The U.S. Pat. No. 1,245,098 issued to J. E. Goldthwait on Oct. 30, 1917 for a "Rowboat Seat" shows a device that uses a pivot point at the base of the device that allows the seat to rock back and forth. Zeidler's device removes control because a paddler with long legs can't kneel under it. The Goldthwait is designed only to be used in a rowboat.

What is needed is a canoe and boat seat incliner apparatus that is designed to be able to be used with any type canoe and boat seat and provide a solid attachment to the hull or gunwale of a boat or canoe and will allow the user to sit or kneel in a canoe or boat without losing support as he or she is changing position in the watercraft. Additionally, what is needed is a device that provides firm, even pressure on the pelvis and femur of the paddler regardless of the position assumed and will rock slightly with the paddling motion, maintaining even pressure. What is also needed is a device that attaches to the gunwale or boat hull and allows the pivot point to be in a position above the seat itself.

It is the object of this invention to teach a canoe or boat seat incliner apparatus which avoids the disadvantages and limitations, recited above in previous boat or canoe seat designs. Another object of this invention is to provide an apparatus that is simple to install, extremely effective and very cost effective, be extremely adjustable, and be maintainable without applying concentrated pressure on the bottom of the canoe hull.

SUMMARY OF THE INVENTION

Particularly, it is the object of this invention to teach a canoe or boat seat incliner apparatus, for use by individuals operating a canoe or boat to shift quickly from the seated position to the kneeling position while, at the same time, being firmly and comfortably supported by the canoe seat, comprising at least one main structure attachment unit for the positioning of the canoe or boat seat incliner apparatus to the hull section or gunwale of the canoe or boat; said main structure attachment unit having guide means for controlling the range of motion of said canoe or boat seat; at least one seat connection means for holding said canoe or boat seat incliner apparatus; said seat connection means comprising means for pivotably connecting said canoe or boat seat to said main structure attachment unit for allowing movement of said canoe or boat seat within the range of motion permitted by said controlling guide means of said main structure attachment unit; and said seat connection means having a projection unit inserted into said guide controlling means of said main structure attachment unit.

It is another object of this invention to teach a canoe or boat seat incliner apparatus, for use by individuals operating a canoe or boat to shift quickly from the seated position to the kneeling position while, at the same time, being firmly and comfortable supported by the seat, comprising a pair of main structure attachment units for the positioning of a canoe or boat seat incliner apparatus to the hull section or the gunwale of the canoe or boat; said main structure attachment units having guide means for controlling the range of motion of said canoe and boat seat; a pair of seat connection means for holding said canoe or boat seat within said canoe or boat seat incliner apparatus; said seat connection means comprising means for pivotably connecting said canoe or boat seat to said main structure attachment units for allowing movement of said canoe or boat seat within the range of motion permitted by said controlling guide means of said main structure attachment units; and said seat connection means further comprising a projection unit inserted into said guide controlling means of said main structure attachment units.

BRIEF DESCRIPTION OF THE DRAWINGS

Further objects and features of this invention will become more apparent by reference to the following description taken in conjunction with the following figures, in which.

DETAILED DESCRIPTION OF THE PREFERRED EMBODIMENT

Figure 1:
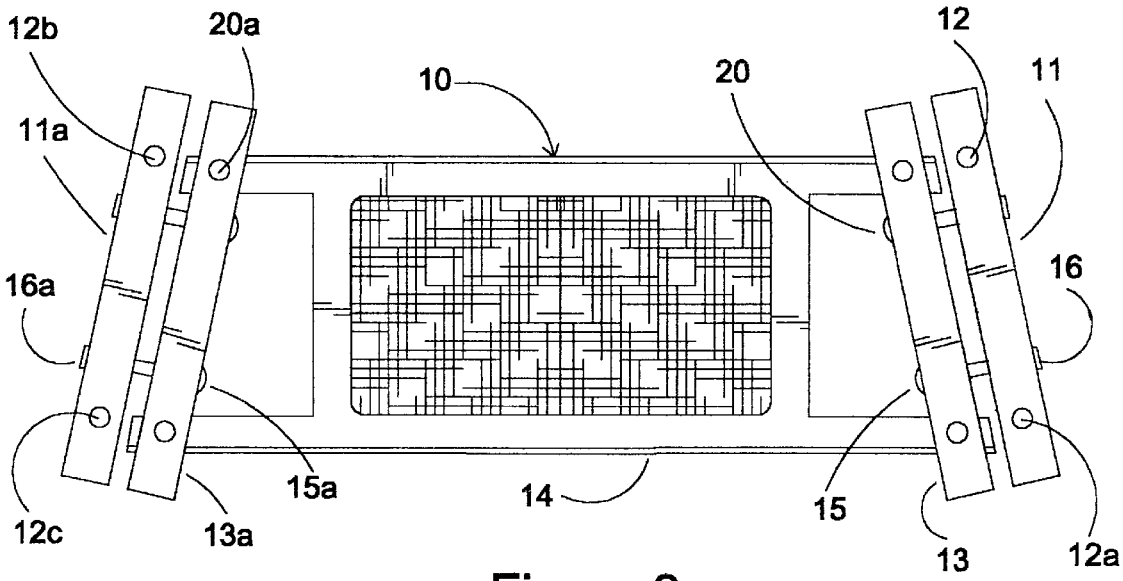
FIG. 1 is a top plan view of the novel canoe and boat seat incliner apparatus.
Figure 3:
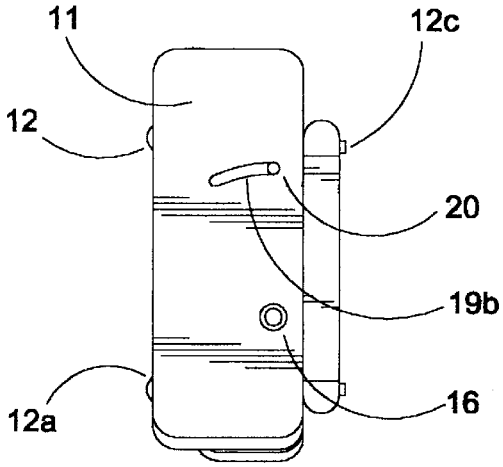
FIG. 3 is a side elevational view thereof.
Figure 2:
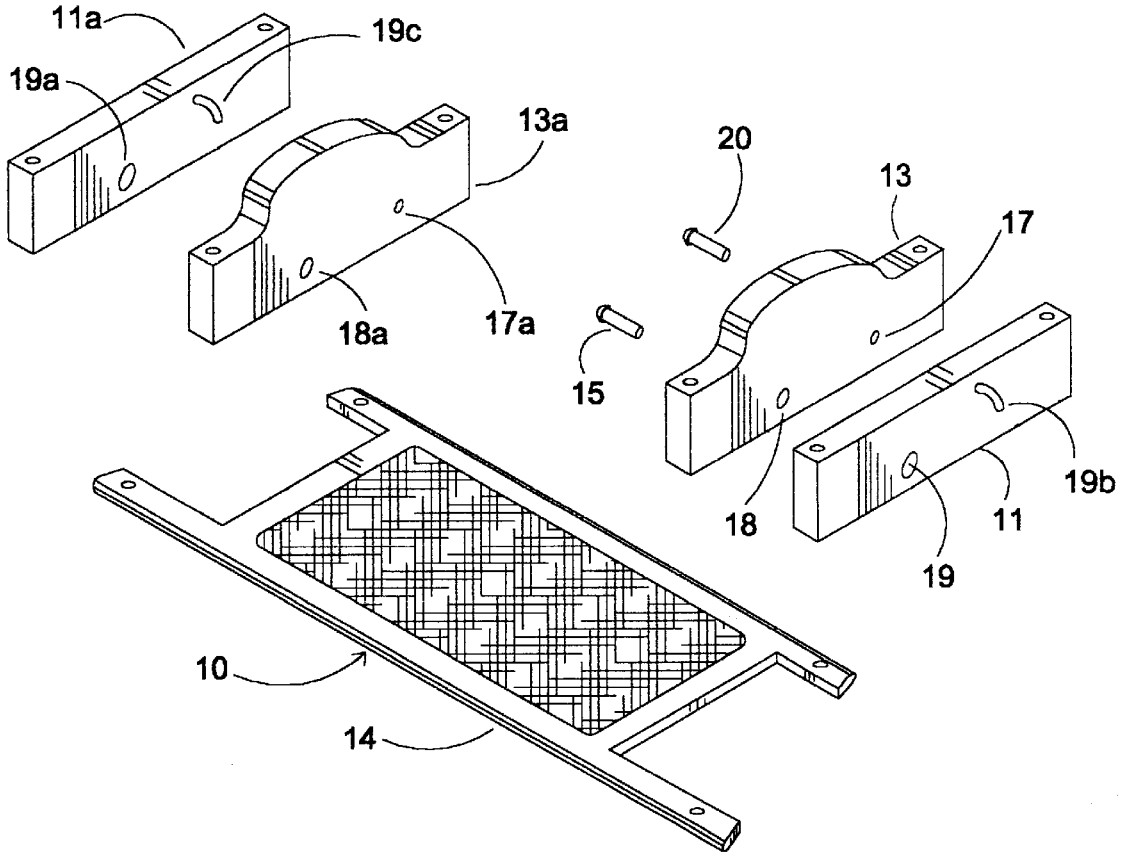
FIG. 2 is an exploded view thereof.
Figure 4:
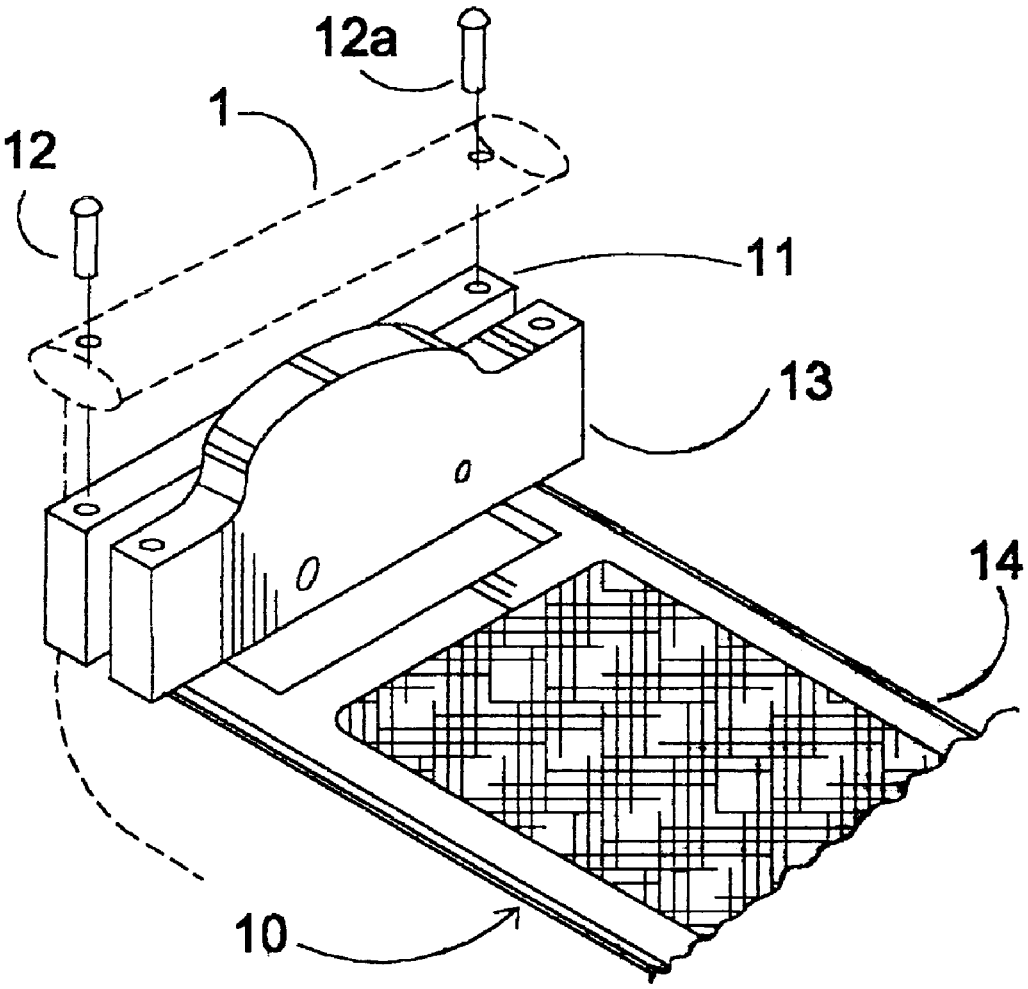
FIG. 4 is a perspective view of the novel canoe and boat seat incliner apparatus in position in a canoe.

As shown in the figures, the novel apparatus 10 comprises a main structure attachment units 11 and 11*a* that is a rigid material, such as wood, having a number of apertures drilled therein. The main structure attachment unit 11 and 11*a* secures the apparatus 10 to the hull or gunwale of a boat or canoe 1 by means of nuts and bolts 12, 12*a*, 12*b* and 12*c* that are positioned through apertures in the hull or gunwales and vertical apertures in the main structure attachment units 11 and 11*a*. The apparatus 10 also has seat connection means 13 and 13*a* which are connected to the seat 14 of the watercraft 1 and to the main structure attachment unit 11 and 11*a*.

The seat connection means 13 and 13*a* are made of a rigid material, such as wood, and are pivotably connected to the main structure attachment units 11 and 11*a* by means of the use of a pivot bolt 15 and 15*a* in conjunction with nuts or T-nuts 16 and 16a and a spacing washer 17 and 17*a*, the spacing washers are not necessary when using T-nuts. The bolts 15 and 15*a* are inserted in apertures 18 and 18*a* in the seat connection means 13 and 13*a* and apertures 19 and 19*a* in the main structure attachment units 11 and 11*a*. This creates a pivot arm for the apparatus that allows the seat 14 to hold a position dictated by the position of the seat and thighs of the individual using the apparatus. The spacing washers 17 and 17*a* are positioned between the seat connection means 13 and 13*a* and the main structure attachment units 11 and 11*a*.

Arcuate apertures 19*b* and 19*c* are cut into the main structure attachment units 11 and 11*a* that is used a guide means for controlling the range of motion for the seat 14 of the boat or canoe. The arcuate apertures 19*b* and 19*c* are shaped so that the upper portion of the aperture is angled toward the front of the watercraft. A projection rod 20 and 20*a* (or bolt and securing T-nut) extending outward from the seat connection means 13 and 13*a* are inserted into the arcuate apertures 19*b* and 19*c* having an upper and lower limit which controls the range of motion that the seat is allowed to travel. The curved shape of the seat connection means is designed to maintain the seat in a horizontal position when the individual using the seat is seated.

In use, the apparatus deals with a number of problems faced by paddlers or rowers in their day to day operations. The design of the canoe or boat seat incliner apparatus is aimed at achieving the primary objective of providing a canoe or boat paddler to have a firm comfortable support in both the sitting and kneeling positions, and to shift from one to the other instantly without interrupting his or her paddling stroke. The seat being suspended simply follows the inclination of the thighs of the individual using the device. The legs of the individual are unencumbered by the seat and fit comfortably under the seat whether the individual is seated or kneeling. The seat can be positioned above or below the pivoting arm of the apparatus, depending upon the depth of the canoe. In shallow canoe, the paddler would prefer the seat above the pivot arm in order to maintain a minimum foot clearance. In deeper recreational canoes, the paddler would suspend the seat below the pivot arm which will allow him or her to maintain minimum leg clearance and, at the same time, keeping the center of gravity as low as possible in order to minimize the chance of overturning the canoe.

While I have described my invention in connection with specific embodiments thereof, it is clearly to be understood that this is done only by way of example and not as a limitation to the scope of my invention as set forth in the objects thereof and in the appended claims.

I claim:

1. A canoe or boat seat incliner apparatus, for use by individuals operating a canoe or boat to shift quickly from the seated position to the kneeling position while, at the same time, being firmly and comfortably supported by the canoe seat, comprising:

at least one main structure attachment unit for the positioning of the canoe or boat seat incliner apparatus to the hull section or gunwale of the canoe or boat;

said main structure attachment unit comprises a unit constructed of a rigid material;

said rigid material having attachment devices inserted into said rigid material through said hull section or gunwale of said canoe or boat for locking said canoe or boat seat incliner apparatus in position on the hull section or gunwale of a canoe or boat;

said main structure attachment unit having guide means for controlling the range of motion of said canoe or boat seat;

said guide means for controlling the range of motion of said canoe or boat seat comprises an arcuate aperture cut into said main structure attachment unit of said canoe or boat seat incliner apparatus for limiting the range of motion of said canoe or boat seat;

said arcuate aperture comprises a slightly curved shape with the upper portion of said arcuate aperture angled toward the forward section of the canoe or boat;

at least one seat connection means for holding said canoe or boat seat within said canoe or boat seat incliner apparatus;

said seat connection means comprising means for pivotably connecting said canoe or boat seat to said main structure attachment units for allowing movement of said canoe or boat seat within the range of motion permitted by said controlling guide means of said main structure attachment unit; and said seat connection means having a projection unit inserted into said guide controlling means of said main structure attachment unit.

2. A canoe or boat seat incliner apparatus, according to claim 1, wherein:

said seat connection means comprises a unit of rigid construction;

said unit of rigid construction having seat securing means for attaching said canoe or boat seat to said seat connection means; and said seat securing means comprises the use of attachment units inserted into apertures in said seat connection means and said canoe or boat seat for securing said canoe or boat seat in position in said canoe or boat seat incliner apparatus.

3. A canoe or boat seat incliner apparatus, according to claim 1, wherein:

said means for pivotably connecting said canoe or boat seat to said main structure attachment unit comprises the use of a pivot bolt inserted through an aperture positioned in said main structure attachment unit and said seat connection means;

said means for pivotably connecting said canoe or boat seat to said main structure attachment unit further comprises the use of a spacing washer positioned between said main structure attachment unit and said seat connection means and having said pivot bolt pass there through; and said means for pivotably connection said canoe or boat seat to said main structure attachment unit further comprises the use of a nut threaded onto said pivot bolt for holding said entire pivotably connecting means together.

4. A canoe or boat seat incliner apparatus, according to claim 1, wherein:

said projection unit comprises a rod inserted through said seat connection means and inserted therein into said arcuate aperture having and upper and lower limit in said main structure attachment unit.

5. A canoe or boat seat incliner apparatus, for use by individuals operating a canoe or boat to shift quickly from the seated position to the kneeling position while, at the same time, being firmly and comfortably supported by the seat, comprising in combination:

a pair of main structure attachment units for the positioning of the canoe or boat seat incliner apparatus to the hull section or gunwale of the canoe or boat;

said pair of main structure attachment units comprise units constructed of rigid materials;

said rigid materials having canoe or boat attachment devices into said rigid materials through the hull section or gunwale of said canoe or boat for locking said canoe or boat seat incliner apparatus in position on the hull section or gunwale of a canoe or boat;

said main structure attachment units having guide means for controlling the range of motion of said canoe or boat seat;

said guide means for controlling the range of motion of said canoe or boat seat comprises an arcuate aperture cut into said main structure attachment units of said canoe or boat seat incliner apparatus for limiting the range of motion of said canoe or boat seat;

said arcuate aperture comprises a slightly curved shape with the upper portion of said arcuate aperture angled toward the forward section of said canoe or boat;

a pair of seat connection means for holding said canoe or boat seat within said canoe or boat seat incliner apparatus;

said seat connection means comprising means for pivotably connecting said canoe or boat seat to said main structure attachment units for allowing movement of said canoe or boat seat within the range of motion permitted by said controlling guide means of said main structure attachment units; and said seat connection means further comprising a projection unit inserted into said guide controlling means of said main structure attatchment unit.

6. A canoe or boat seat incliner apparatus, according to claim 5, wherein:

said pair of seat connection means comprises units of rigid construction;

said units of rigid construction having seat securing means for attaching said canoe or boat seat to said seat connection means; and said seat securing means comprises the use of nuts and bolts inserted into apertures in said seat connection means and said canoe or boat seat for securing said canoe or boat seat in position within said canoe or boat seat incliner apparatus.

7. A canoe or boat seat incliner apparatus, according to claim 5, wherein:

said means for pivotably connecting said canoe or boat seat to said main structure attachment unit comprises the use of a pivot bolt inserted through an aperture positioned in said main structure attachment unit and said seat connection means;

said means for pivotably connecting said canoe or boat seat to said main structure attachment unit further comprises the use of a spacing washer positioned between said main structure attachment unit and said seat connection means and having said pivot bolt pass there through; and said means for pivotably connecting said canoe or boat seat to said main structure attachment unit further comprises the use of a nut or T-nut threaded onto said pivot bolt for holding said entire pivotably connecting means together.

8. A canoe or boat seat incliner apparatus, according to claim 5, wherein:

said projection unit comprises a rod inserted through said seat connection means and inserted therein into said arcuate aperture in said main structure attachment unit.

* * * * *